US005521680A

United States Patent [19]

Young

[11] Patent Number: 5,521,680

[45] Date of Patent: May 28, 1996

[54] PRINTER HAVING A SELF-ALIGNING CHARGING DEVICE

[75] Inventor: David K. Young, Fairport, N.Y.

[73] Assignee: Xerox Corporation, Stamford, Conn.

[21] Appl. No.: 360,900

[22] Filed: Dec. 21, 1994

[51] Int. Cl.[6] ..... G03G 15/02; G03G 21/16

[52] U.S. Cl. ..... 355/219; 355/200

[58] Field of Search ..... 355/219, 221, 355/200, 210; 361/229; 350/324–26

[56] References Cited

U.S. PATENT DOCUMENTS

| | | | |
|---|---|---|---|
| 2,836,725 | 5/1958 | Vyverberg | 250/49.5 |
| 2,879,395 | 3/1959 | Walkup | 250/49.5 |
| 3,691,373 | 9/1972 | Compton et al. | 250/49.5 |
| 5,324,941 | 6/1994 | Gross et al. | 250/324 |
| 5,342,942 | 6/1994 | Mishra et al. | 250/326 |

*Primary Examiner*—Joan H. Pendegrass
*Attorney, Agent, or Firm*—Tallam I. Nguti

[57] ABSTRACT

An automatically self-aligning charging device assembly for producing a layer of charge on a charge holding surface in alignment with a document registration position on the platen of a machine. The assembly includes a charging element having a start-of-charging position thereto, and a housing enclosing the charging element. The assembly also includes a stop member mounted to the frame of the machine at a first side of the platen for contacting a first end of the housing at a desired point so as to automatically align the start-of-charging position of the charging element with the document registration position. A resilient force applying member connected to a second end of the housing automatically absorbs corrective adjustments to a location of the start-of-charging position of the charging element relative to the document registration position on the platen, thereby automatically aligning the start-of-charging position with the document registration position.

19 Claims, 2 Drawing Sheets

PRINTER HAVING A SELF-ALIGNING CHARGING DEVICE

BACKGROUND OF THE INVENTION

This invention relates to electrostatographic reproduction machines, and more particularly to such a machine including an automatically self-aligning charging device assembly.

Generally, the process of electrostatographic copying is executed by first using a corona generating or charging device to uniformly charge a photoreceptive member, and then exposing a light image of an original document, positioned in registration on a platen, onto the charged photoreceptive member. Exposing the charged photoreceptive member to a light image discharges the photoconductive surface thereof in areas corresponding to non-image areas in the original document, while maintaining the charge on other areas thereof, particularly on the image areas, thus creating an electrostatic latent image on the photoreceptive member. The undischarged areas including the electrostatic latent image are subsequently developed with charged toner particles into a visible toner image. The toner image is thereafter transferred from the photoreceptive member onto a copy sheet on which the image is then fused or permanently affixed in order to provide a hard copy reproduction of the original document.

The described process is well known and is useful for light lens copying from an original, as well as for printing documents from electronically generated or stored originals. Analogous processes also exist in other electrostatographic applications such as, for example, digital printing applications wherein the latent image is generated by a modulated laser beam or ionographic printing and reproduction, where charge is selectively deposited on a charge retentive surface in accordance with an image stored in electronic form.

In the any of the above processes, a conventional form of a corona generating or charging device that can be used is disclosed, for example, in U.S. Pat. No. 2,836,725 as a basic corotron device. As disclosed, the corotron device includes a conductive corona generating electrode in the form of an elongated wire that is partially surrounded by a conductive shield. The corona generating electrode, or so called coronode, is provided with a DC voltage, while the conductive shield is usually electrically grounded and the dielectric surface to be charged is spaced proximate to the wire. Alternatively, the corotron device may be biased in a manner taught, for example, in U.S. Pat. Nos. 2,879,395, and 5,324,941 and 5,324,942 which describe a type of charging device known as a scorotron. In a scorotron, an AC corona generating potential is applied to the conductive wire electrode while a DC biasing potential is applied to a conductive shield partially surrounding the electrode. This DC potential regulates the flow of ions from the electrode to the surface to be charged so that the charge rate can be adjusted, making this biasing system ideal for self-regulating systems.

Another type of a charging device that is usable in any of the above processes is a pin array device that includes a charging electrode which may be an electrically conductive strip having projections, or scalloped portions in the form of teeth members. The projections or teeth members are integrally formed with, and extend from, a longitudinal edge of the electrode. This type of charging device is disclosed for example in U.S. Pat. No. 3,691,373 to Compton et al. As shown, this type of corona generating device may further include a screen and/or an auxiliary electrode as well as various additional conductive shields for regulating charging current to control the uniformity of produced charge.

Regardless of the particular type, a charging device when used in an electrostatographic machine, is mounted spaced from, and axially relative to the photoreceptive member of the machine. In order not to produce hard copies of images on sheets with toned or black borders, non-image border areas on the photoreceptive member must either not be charged by the charging device, or if charged must then be erased or discharged prior to development with charged toner particles. "Charging and then erasing or discharging" such border areas after uniform charging involves additional use of discharge devices, and is therefore relatively more costly. In addition, it is also relatively more risky in that more or less border area than is necessary may be erased, thus resulting in poor quality images. On the other hand, the relatively less risky and less expensive alternative which is "not to charge such border areas in the first place", requires a precise alignment of an edge of the areas to be charged (which is the same as a position where the charging device starts charging) with a document registration position or edge on a fixed platen.

Unfortunately, however, due to the effects of manufacturing and assembly tolerances, achieving such precise alignment normally requires skills not possessed by an ordinary machine user or customer. This can be more of a problem in the case of charging devices that are manufactured and provided along with other components as customer replaceable (cartridge) units or CRU's that are to be mounted in the machine by the user or customer. In such cases, the-start-of-charging position of the charging device may or may not be aligned with a desired image edge position on the photoreceptive member. In addition, there may be a misalignment created between the registration position or edge on the platen and such start-of-charging position of the charging device. The challenge to the user or customer then is to replace the charging device such that its start-of-charging position is precisely aligned with the registration position on the platen, and with a corresponding image edge position on the photoreceptive member. Failure to achieve such alignment ordinarily will result each time in an image on a copy sheet of paper that has a darkened border, or that has a clipped image portion adjacent such border, either of which is unacceptable.

There is therefore a need to provide for use in an electrostatographic reproduction machine, a customer replaceable unit that includes a self-aligning charging device which automatically aligns its start-of-charging position with a platen document registration position.

SUMMARY OF THE INVENTION

In accordance with one aspect of the present invention, in order to reproduce an image without a darkened border or clipped edge, there is provided in a reproduction machine having a frame, a charge holding surface and a document platen including a document registration position, an automatically self-aligning charging device assembly for producing a layer of electrostatic charge onto the charge holding surface in alignment with the document registration position on the platen. The automatically self-aligning charging device assembly includes a corona generator having a start-of-charging position, and a stop member mounted to the frame of the machine at a first side of the platen for contacting a first end of the corona generator at a desired position so as to automatically align the start-of-charging position relative to the document registration position on the platen. A resilient force applying member supported within the reproduction machine and connected to a second end of the corona generator for automatically aligning the start-of-charging position at the desired position relative the document registration position.

In accordance with another aspect of the present invention, there is provided for use in a printing machine so as to produce copies of documents without darkened borders or clipped edges, a customer replaceable unit (CRU) including a housing for mounting to a frame of the printing machine and a corona generator having a first end mounted to the housing and a second end for contacting a stop member within the printing machine so as to position the corona generator at a predetermined desired position relative to a document registration position of the printing machine. The CRU also includes resilient force applying means connecting the first end of the corona generator to the housing for resiliently urging the second end of the housing into contact with the stop member when the CRU is used in the printing machine.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2:
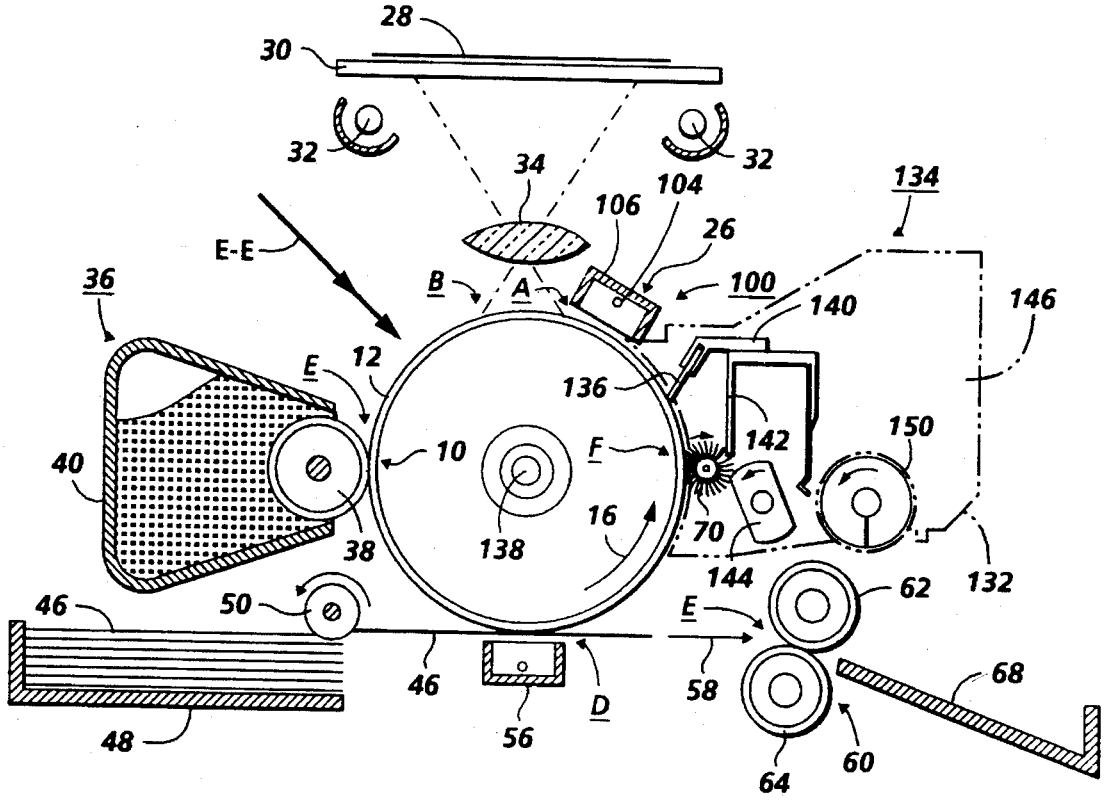
FIG. 2 is a schematic view showing an electrostatographic reproduction machine employing the self-aligning charging device assembly of the present invention.

Referring initially to FIG. 2, an exemplary electrostatographic reproduction machine incorporating the automatically self-aligning charging device assembly of the present invention is illustrated. The exemplary electrophotographic machine, for example, employs a photoreceptive member shown as a drum 10 including a photoconductive surface 12. As is well known, the photoconductive member can equally be a suitably mounted belt having a photoconductive surface. The photoconductive drum 10 is coupled to motor (not shown) for rotation about a process path in the direction of arrow 16 for advancing successive portions of photoconductive surface 12 through various processing stations disposed about the process path.

Initially, a surface portion of drum 10 passes through a charging station A. At charging station A, a corona generating device 26 such as is included in the automatically self-aligning charging device assembly of the present invention (to be described in detail below), charges photoconductive surface 12 to a relatively high and substantially uniform potential.

Once charged, photoconductive surface 12 is advanced to an imaging station B where an original document 28, positioned face down and in accordance with a fixed registration mark or position on a transparent platen 30, is exposed to light from light sources, such as lamps 32. Light rays from the lamps 32 are reflected imagewise from the document 28 thus forming a light image of the original document 28. The reflected rays are transmitted through a lens 34 and focused onto a portion of the charged photoconductive surface 12, selectively dissipating the uniform charge on impacted areas thereof. As such, an electrostatic latent image corresponding to the original document 28 is recorded onto photoconductive surface 12.

Although an optical system has been shown and described for forming the light image used to selectively discharge the charged photoconductive surface 12, one skilled in the art will appreciate that a properly modulated scanning beam of energy (e.g., a laser beam) may equally be used to imagewise irradiate the charged portion of the photoconductive surface 12 in order to record the latent image thereon.

After the electrostatic latent image is recorded on photoconductive surface 12, drum 10 advances to development station C where a development apparatus 36, deposits developing material containing charged toner particles onto the electrostatic latent image. Development apparatus 36 for example may include a single developer roller 38 disposed in a developer housing 40. The developer roller 38 rotates, bringing the developing material into contact with photoconductive surface 12, thus developing the latent image into a visible toner image.

After development of the electrostatic latent image as such, drum 10 advances the toner image to transfer station D. At transfer station D, a sheet of support material 46 is moved into contact with the toner image by means of a sheet feeding apparatus 48. Preferably, sheet feeding apparatus 48 includes a feed roller 50 which rotates while in contact with a stack of sheets 46 to advance the uppermost sheet. The advancing sheet of support material 46 is moved into contact with photoconductive surface 12 of drum 10 at transfer station D in a timed sequence so that the developed image on the surface 12 contacts the advancing sheet of support material 46, and is transferred. A transfer corotron 56 is provided for projecting ions onto the backside of sheet 46 in order to aid in inducing the transfer of charged toner images from the photoconductive surface 12 onto support material 46.

The support material 46 is subsequently transported in the direction of arrow 58 for advancement to a fusing station E. Fusing station E includes a fuser assembly 60 for heating and permanently affixing the transferred toner image to sheet 46. Fuser assembly 60 preferably includes a heated fuser roller 62 and a support roller 64 forming a fusing nip for receiving and transporting a sheet of support material 46 therethrough. After fusing, the advancing sheet of support material 46 is moved to a receiving tray 68 for subsequent removal of the finished copy by an operator.

Invariably, after the support material 46 was separated from the photoconductive surface 12 of drum 10, some residual developing material remained adhered to drum 10. Thus, a final processing station, namely cleaning station F, is provided for removing residual toner particles from photoconductive surface 12 in preparation for subsequent charging and imaging as described above. Cleaning station F, for example, can include a rotatably mounted fibrous brush 70 for physical engagement with photoconductive surface 12 in order to remove toner particles therefrom. As shown, the cleaning station F may be provided for example as part of a customer replaceable unit or CRU 134. CRU 134 as illustrated comprises a CRU housing 132 enclosing cleaning components, such as the brush 70, and a cleaning blade 136.

In some cases, the CRU 134 may also include the photoreceptor drum 10 shown mounted on a drum shaft 138 and rotatably driven in the direction of the arrow 16. The cleaning blade 136 is mounted on a supporting bracket 140, and the cleaning brush 70 is mounted for disturbing and removing toner particles from the surface of the drum 10 prior to such surface being cleaned by the cleaning blade 136. A flicker bar 142 may be included for flicking the waste toner off of the brush 70, and a square paddle 144 for transporting the waste toner to the rear of a waste toner sump 146, where an auger 150 may then transport the toner away from the cleaning area.

The foregoing description is believed to be sufficient, for purposes of the present application for patent, to illustrate the general operation of an electrostatographic reproduction or printer machine including the self-aligning corona generating or charging device of the present invention.

Figure 1:
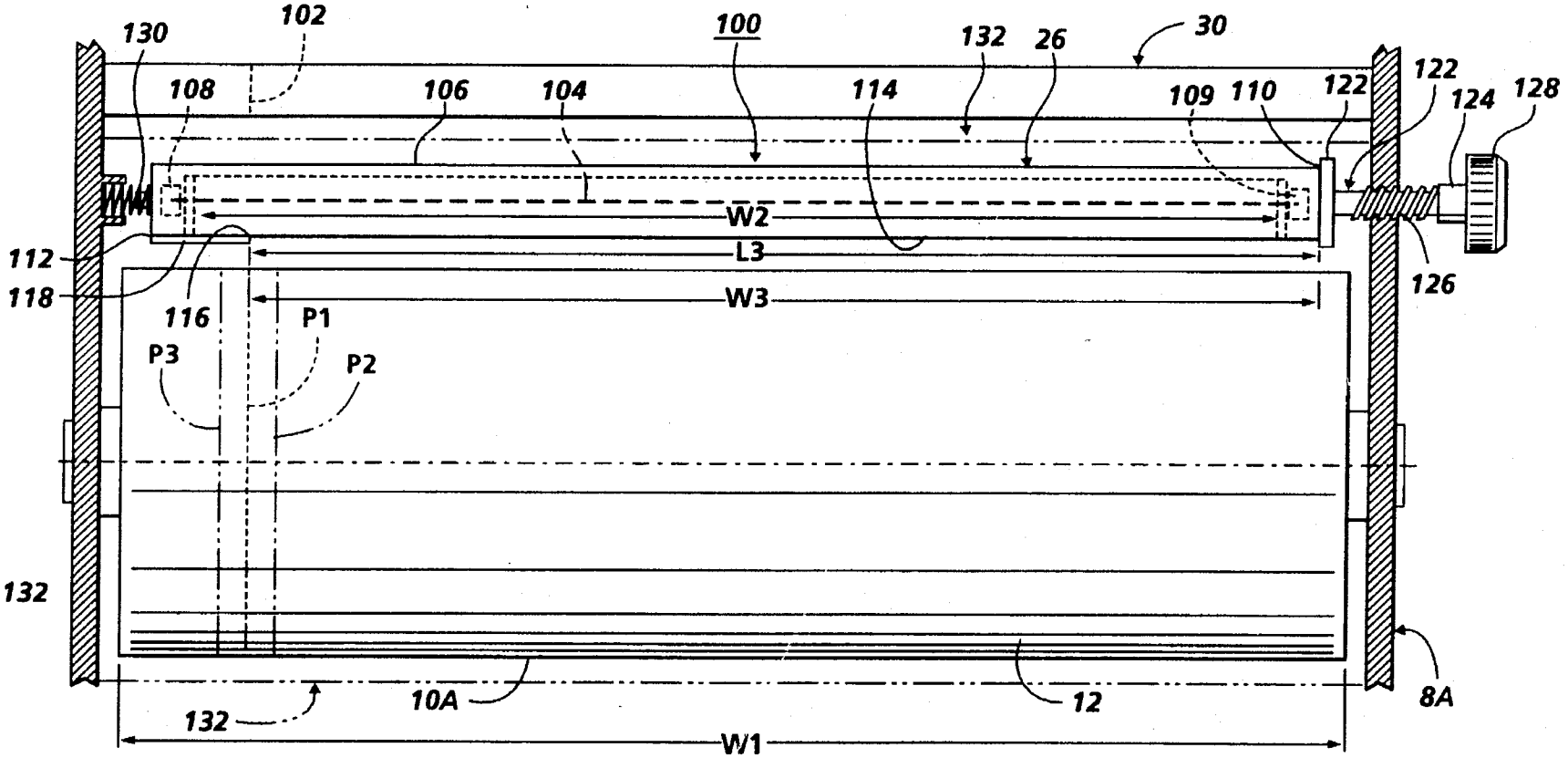
FIG. 1 is a schematic side view of the platen, photoreceptive member and self-aligning charging device assembly of the present invention.

Referring now to FIGS. 1 and 2, a portion of the electrostatographic reproduction machine is illustrated as viewed, for example, from the direction of the arrow E—E. As illustrated, the machine includes the automatically self-aligning charging device assembly of the present invention, shown generally as 100. The machine also includes a machine frame 8A, and the document platen 30 that is mounted to the frame 8A. The platen 30 includes a document registration position 102 which is useful for properly registering a document so that it can be reproduced with cleaned undarkened borders, as well as without clipped developed image edges. The machine further includes imaging means for employing a layer of electrostatic charge along with charged toner particles, as described above, to reproduce an original image of a document. The imaging means particularly include the photoreceptor or photoconductive member such as the drum 10. Drum 10 has the photoconductive surface 12 and an available predetermined chargeable surface-width W1 thereof for holding the layer of electrostatic charge. According to the present invention, the charging device assembly 100 is automatically and resiliently self-aligned relative to the document registration position 102 so as to result in unclipped edge copies with clean, undarkened borders.

As further illustrated, the automatically self-aligning charging device assembly of the present invention 100 includes the charging device or corona generator 26 which has a charging element 104 for charging the charge holding photoconductive surface 12. The charging element 104 is a corona generating electrode which for example can be a pin array electrode as are well known, or a wire electrode. The charging element 104, for example, a pin array electrode, is ordinarily coupled to a high-voltage extension member, or provided with a high voltage extension member for connection to a high-voltage power source (not shown). The charging element 104 preferably has a charging length W2 approximately equal to the chargeable width W1 of the surface of the photoreceptor 10.

The charging device or corona generator 26 includes an elongate housing 106 having a first end 110 and a second end 112 defining first and second ends of the corona generator 26. The housing 106 is mounted within the reproduction machine, below the document platen 30. The housing 106, as shown, supports the charging member 104 therein by means of end blocks 108, 109, and partially surrounds the charging element. The elongate housing 106 is preferably attached to, and comprises a component of the customer replaceable cartridge unit, or CRU 134. When the charging element 104 is a pin array, the elongate housing 106 may be comprised of side support members and the pair of end mounting blocks 108, 109 positioned within a shield support frame. The side support members may comprise elongate members disposed on either side of, and sandwiching, the pin array electrode. The side support members thus extend between the end mounting blocks for supporting the electrode within the conductive shield or housing 106.

The housing 106 has the first end 110, and the second end 112 that is positionable towards the document registration position 102 side of the platen 30. As shown, the elongate housing 106 includes a charge dispensing aperture 114 extending between the first and second ends 110, 112 respectively for releasing and directing charge from the charging element 104 onto the surface 12 of the photoreceptor 10. The charge dispensing aperture 114 includes a start-of-charging position 116 for the charging element 104. The start-of-charging position 116 of the charge dispensing aperture as shown is defined, for example, by an adjustable charge blocking member 118 that is mounted partially over the aperture, and towards the second end 112 of the housing 106.

The automatically self-aligning charging device assembly 100 also includes a stop member 120 for contacting the first end 110 of the elongate housing 106. The stop member 120 as shown is mounted below the platen 30 to the machine frame 8A, and is spaced a predetermined distance W3 from a desired position P1 directly below the document registration position 102 of the platen 30. The predetermined distance W3 from the stop member 120 to the desired position P1 is importantly made equal to a length L3 of the elongate housing 106 from its first end 110 to the start-of-charging position 116 of the charge dispensing aperture 114. The stop member 120 as mounted through the machine frame 8A, includes a first end 122 for contacting the housing 106, and a second end 124 thereof that is positioned externally of the machine frame 8A, for example. The stop member 120 as further shown includes means such as a threaded shaft portion 126 thereof, and a thumb graspable portion 128 connected to the second end 124 thereof for manually adjusting the stopping position of the stop member, and thereby increasing or decreasing the predetermined distance W3 therefrom to the desired position P1. The first end 122 thereof is importantly adjusted and set so as to contact the first end 110 of housing 106 and stop the charging device 26 (i.e. housing 106 with charging element 104) at the far side of the platen 30 from the document registration position 102.

The automatically self-aligning charging device assembly 100 further includes a resilient force applying member 130 that is supported within the reproduction machine and is connected to the second end 112 of the elongate housing 106. The resilient force applying member 130, for example, is shown as a compressible spring member, however, it can equally be any suitable spring device including pneumatic and hydraulic such devices. The resilient force applying member 130 as such is useful for automatically aligning the start-of-charging position 116 of the charge dispensing aperture 114 at the desired position P1 directly below the document registration position 102, when the first end 110 of the elongate housing 106 is contacting the stop member 130. In other words, as connected to the second and opposite end 112 of the elongate housing 106, the resilient force applying member 130 is suitable for automatically absorbing corrective adjustments to a location of the start-of-charging position 116 of the charging element relative to the document registration position 102 on platen 30, and thereby automatically aligning the start-of-charging position 116 with the document registration position 102.

Preferably, the resilient force applying member 130 is supported on the housing 132 of the customer replaceable unit (CRU) 134 so as to be replaceable therewith within the machine. As illustrated, without the advantageous features of the present invention, due to manufacturing and assembly out of tolerance conditions, the start-of-charging position 116 may have anyone of three different corresponding positions P1, P2 and P3 on the surface 12. Position P1 is, of course, ideal and is that which is automatically achievable according to the present invention. Positions P2 and P3 are undesirable. Position P2 as can be expected will produce copies with clipped border areas, and position P3 will produce copies with darkened or toned borders.

However, as further illustrated, the resilient force applying member 130 is importantly made to have a first, uncompressed position in which it causes the housing 106 to intentionally place the start-of-charging position 116 at an undesirable position such as P2 within the predetermined distance W3. The resilient force applying member 130 is also such as will have a second, compressed position as illustrated in which it causes the housing 106 to automatically place the start-of-charging position desirably at position P1. This second compressed position of the spring 130 is defined and determined by the force applying member 130 automatically moving the first end 110 of the elongate housing into contact with the stop member 120. The length L3 of the hosing 106 from its first end 110 to the start-of-charging position 116 is such that compression of the spring 130 by the length L3 will automatically align the start-of-charging position 116 of the charging element at the desired position P1 directly below the document registration position 102.

A main advantage of the automatically self-aligning charging device assembly 100 is that the position of the end 122 of stop member 120 can be preset or adjusted in the machine for a particular batch of CRU's 134 that include the device assembly 100 with contact end 110. Once the position of the end 122 of stop member 120 has been adjusted in the machine as above, the device assembly 100 in each CRU that is subsequently mounted in the machine as a replacement of a previously aligned CRU therein, will according to the present invention, automatically set or align the start-of-charging position 102 to the desired position P1, despite the presence of any out-of-tolerance conditions in each such device assembly.

It is, therefore, apparent that there has been provided in accordance with the present invention, an automatically self-aligning charging device assembly 100 for producing a layer of electrostatic charge onto a photoconductive surface 12 in alignment with a document registration position 102 on a platen 30. The self-aligning charging device assembly 100 includes a charging element 104, and an elongate housing 106 enclosing the charging element and having a start-of-charging position 116 thereto. The self-aligning charging device assembly also includes a stop member 120 mounted to the frame of the machine at a first side of the platen for contacting a first end 110 of the elongate housing at a desired point for automatically aligning the start-of-charging position of the charging element with the document registration position on the platen. A resilient force applying member 130 is connected to a second and opposite end 112 of the elongate housing for automatically absorbing corrective adjustments to location of the start-of-charging position of the charging element relative to the document registration position on the platen, and thereby automatically aligning the start-of-charging position with the document registration position.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. In an electrostatographic reproduction machine having a frame, a charge holding photoconductive surface, and a document platen including a document registration position useful for producing copies of documents without darkened borders or clipped edges, an automatically self-aligning charging device assembly comprising:

(a) a corona generator for charging the photoconductive surface;

(b) a stop member for contacting said corona generator, said stop member being mounted within the reproduction machine below the platen and spaced a predetermined distance from a desired position directly below the document registration position of the platen; and (c) a resilient force applying member supported within the reproduction machine and connected to said corona generator, said resilient force applying member automatically moving said first end of said corona generator into contact with said stop member in order to align said start-of-charging position of said charge dispensing aperture at the desired position relative to the document registration position.

2. The self-aligning charging device assembly of claim 1, wherein said corona generator includes a housing defining a first end and a second end of said corona generator, and having a charge dispensing aperture, said charge dispensing aperture including a start-of-charging position, and extending between said first end and said second end of said corona generator for dispensing charge from said corona generator.

3. The self-aligning charging device assembly of claim 2, including an adjustable position charge blocking member mounted over said charge dispensing aperture for defining said start-of-charging position.

4. The self-aligning charging device assembly of claim 2, wherein said predetermined distance from said stop member to the desired position below the document registration position of the platen is equal to a length of said housing from said first end of said corona generator to said start-of-charging position of said charge dispensing aperture.

5. The self-aligning charging device assembly of claim 2, wherein said stop member is mounted to the machine frame below the platen, and said resilient force applying member is supported on a customer replaceable unit housing for mounting by a customer within the machine.

6. The self-aligning charging device assembly of claim 2, wherein said resilient force applying member is a compressible spring member.

7. The self-aligning charging device assembly of claim 2, wherein said resilient force applying member has a first uncompressed position placing said start-of-charging position within said predetermined distance towards said stop member, and a second compressed position determined by said first end of said corona generator contacting said stop member, said second compressed position automatically aligning said start-of-charging position for said ccorona generator at the desired position relative the document registration position of the platen.

8. The self-aligning charging device assembly of claim 2, wherein said stop member includes means for adjusting a position of said stop member, thereby increasing or decreasing said predetermined distance from said stop member to the desired position under the registration position of the platen.

9. The self-aligning charging device assembly of claim 8, wherein said adjusting means comprises a threaded shaft portion of said stop member and a thumb graspable portion of said stop member for manually adjusting the stopping position of said stop member relative to the desired position.

10. The self-aligning charging device assembly of claim 2, wherein said housing is mounted below the document platen.

11. An electrostatographic reproduction machine comprising:

(a) a machine frame;

(b) a platen mounted to said frame and including a document registration position for registering a document to be reproduced without clipped edges and with clean undarkened borders;

(c) imaging means employing a layer of electrostatic charge and charged toner particles to reproduce an original image of the document, said imaging means including a photoconductive surface having an available predetermined width for holding said layer of electrostatic charge;

(d) a self-aligning charging device assembly for producing said layer of electrostatic charge onto said photoconductive surface in alignment with said document registration position on said platen, said self-aligning charging device assembly including:

(i) a charging element having a start-of-charging position;

(ii) a housing enclosing said charging element;

(iii) a stop member mounted to said machine frame at a first side of said platen for contacting a first end of said housing to automatically align said start-of-charging position of said charging element with said document registration position on said platen; and (iv) a resilient force applying member connected to a second and opposite end of said housing for automatically absorbing corrective adjustments to a location of said start-of-charging position of said charging element relative to said document registration position on said platen, thereby automatically aligning said start-of-charging position with said document registration position.

12. The reproduction machine of claim 11, wherein said stop member is mounted to said frame of the machine adjacent said photoconductive member and includes a first end thereof for contacting a second end of said charging device to stop movement by said resilient force applying member of said start-of charging position of said charging element to a point within said predetermined distance.

13. The reproduction machine of claim 12, wherein said stop member is mounted through said machine frame to a point within the machine, and includes a second end thereof positioned externally of said machine frame.

14. The reproduction machine of claim 12, wherein said stop member is adjustable and includes a threaded portion for threaded movement through said machine frame.

15. The reproduction machine of claim 12, wherein said stop member includes manipulating means connected to said second end for manipulating and adjusting a position of said first end thereof relative to said predetermined width of said photoconductive member.

16. The reproduction machine of claim 11, wherein said housing enclosing said charging element is attached to, and comprises a component of a customer replaceable cartridge unit (CRU), said CRU further comprising a cartridge housing and cleaning components of the reproduction machine.

17. The reproduction machine of claim 16, wherein said housing enclosing said charging elements is attached externally to said CRU housing.

18. The reproduction machine of claim 11, wherein said charging element comprises a corona wire electrode.

19. The reproduction machine of claim 1, wherein said housing includes a charge dispensing aperture extending between the first and second ends of said charging device.

* * * * *